US010366854B2

(12) United States Patent
Gorenflo et al.

(10) Patent No.: US 10,366,854 B2
(45) Date of Patent: Jul. 30, 2019

(54) CONTACTOR WITH COIL POLARITY REVERSING CONTROL CIRCUIT

(71) Applicant: TYCO ELECTRONICS CORPORATION, Berwyn, PA (US)

(72) Inventors: Richard R. Gorenflo, Nevada, OH (US); Richard A. Gast, Bellville, OH (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 359 days.

(21) Appl. No.: 15/365,020

(22) Filed: Nov. 30, 2016

(65) Prior Publication Data

US 2018/0151321 A1 May 31, 2018

(51) Int. Cl.

| | |
|---|---|
| ***H01H 73/18*** | (2006.01) |
| ***H01H 51/22*** | (2006.01) |
| ***H01H 51/27*** | (2006.01) |
| ***H01H 50/02*** | (2006.01) |
| ***H01H 50/04*** | (2006.01) |
| ***H01H 89/06*** | (2006.01) |

(52) U.S. Cl.

CPC ..... *H01H 73/18* (2013.01); *H01H 50/021* (2013.01); *H01H 50/045* (2013.01); *H01H 51/2209* (2013.01); *H01H 51/27* (2013.01); *H01H 89/06* (2013.01); *H01H 2051/2218* (2013.01)

(58) Field of Classification Search

CPC .... H01H 73/18; H01H 50/021; H01H 50/045; H01H 51/2209; H01H 2051/2218

USPC ..... 361/13, 170

See application file for complete search history.

(56) References Cited

U.S. PATENT DOCUMENTS 4,176,388 A 11/1979 Palmer
4,682,801 A * 7/1987 Cook ..... E05C 19/166 292/251.5

(Continued)

FOREIGN PATENT DOCUMENTS

WO 00/70634 A1 11/2000

OTHER PUBLICATIONS

Clark, O. M., Transient Voltage Suppressor Types and Applications, Power Conversion & Intelligent Motion, Intertec Communications, Nov. 30, 1990, vol. 16, No. 11, pp. 19, 21-26, Venture, CA, USA.

(Continued)

*Primary Examiner* — Zeev V Kitov

(57) ABSTRACT

A contactor includes a plurality of switches mechanically coupled to an actuator. The actuator is moveable between operational and tripped positions. Switches that are closed in the operational position are open in the tripped position, and vice versa. The actuator extends through a coil as a core. The coil moves the actuator when an input signal is applied to the coil. A first input circuit receives a power-up input signal to transition the contactor from a tripped position to an operational position. A second input circuit receives a trip signal to transition the contactor from the operational position to the tripped position. First and second switches, coupled to respective first and second ends of the coil, reverse the polarity of the coil each occurrence of the actuator being actuated in preparation for the coil to be energized and magnetically polarized in an opposite direction during a next subsequent actuation.

20 Claims, 3 Drawing Sheets

(56) References Cited

U.S. PATENT DOCUMENTS

| | | | | |
|---|---|---|---|---|
| 5,018,043 | A | 5/1991 | Moreau | |
| 5,241,290 | A * | 8/1993 | Sehmer | H01H 71/56 335/132 |
| 6,507,255 | B1 * | 1/2003 | Ennis | H01H 47/226 335/13 |
| 6,837,729 | B2 | 1/2005 | Hogue et al. | |
| 7,486,496 | B2 * | 2/2009 | Gauxmann | H01F 7/1816 361/139 |
| 9,373,468 | B2 | 6/2016 | Priest | |
| 2003/0210117 | A1 | 11/2003 | Arnholt | |
| 2005/0035667 | A1 * | 2/2005 | Joannou | H01H 1/20 307/125 |
| 2008/0165457 | A1 * | 7/2008 | Premerlani | H01H 59/0009 361/31 |
| 2014/0293666 | A1 | 10/2014 | Merz et al. | |
| 2014/0361858 | A1 | 12/2014 | Hae et al. | |
| 2015/0145620 | A1 * | 5/2015 | Connell | H01H 50/44 335/63 |
| 2016/0042899 | A1 | 2/2016 | Zhou | |

OTHER PUBLICATIONS

International Search Report, Application No. PCT/IB2017/057488, International Filing Date, Nov. 28, 2017.

* cited by examiner

CONTACTOR WITH COIL POLARITY REVERSING CONTROL CIRCUIT

FIELD OF THE INVENTION

The present invention is directed to a contactor with a coil polarity reversing control circuit. In particular the invention is directed to a coil polarity reversing circuit that reverses the magnetic polarity of the coil each occurrence of the actuator being actuated.

BACKGROUND OF THE INVENTION

Present latching contactors employ two separate coils wound with opposite magnetic polarity to initiate a change of state of the latching contactor. Latching contactors employ a first coil that is energized momentarily to transition the contactor from a first state, such as a tripped state, to a next state, such as an operational state, to close the power mains switches and position all other contactor switches in respective states corresponding to the mains switches being in the closed, power-on state. A second coil of the opposite magnetic polarity is energized momentarily to transition the contactor to a next state, such as a tripped state, to open the mains switches and position all other contactor switches in respective states corresponding to the mains switches being in the opened, power-off state.

Traditionally, two coils have been employed to actuate the contactor. One coil was on each side of the armature pivot. The two coils were wound to provide opposite magnetic polarity. Each coil was dedicated to providing actuation in a predetermined direction.

A new generation of contactor is needed that transitions from a present state to a next state fifty percent faster than present contactors. Due to limited space for the coil windings, increasing the coil size to achieve increased speed is undesirable. Furthermore, a higher coil current rating is needed, without requiring additional volumetric space, to achieve the faster state transitions.

SUMMARY OF EMBODIMENTS OF THE INVENTION

An embodiment is directed to a contactor including a plurality of switches, a first input circuit for receiving a power-up input signal and a second input circuit for receiving a trip input signal. A movable actuator is mechanically coupled to switches in the plurality of switches. The actuator is moveable between a tripped position and an operational position upon receipt of a power-up input signal on the first input circuit, and moveable between the operational position and the tripped position upon receipt of a trip input signal on the second input circuit. A coil has first and second ends. The moveable actuator extends through the coil as a core. The coil is capable of moving the actuator when either a power-up input signal is received by the first input circuit or a trip input signal is received by the second input circuit. First and second switches are coupled to respective first and second ends of the coil for reversing the polarity of the coil each occurrence of the actuator being actuated. The first and second switches are switchable to include the coil in the second input circuit when the actuator is in the operational position such that when the trip input signal is received on the second input circuit the coil is energized to operate the actuator to transition to the tripped position. The first and second switches are switchable to include the coil in the first input circuit when the actuator is in the tripped position such that when the power-up input signal is received on the first input circuit the coil is energized to operate the actuator to transition to the operational position. As the actuator is being actuated the first and second switches change state in preparation to energize the coil to be polarized in an opposite polarization direction during a next subsequent actuation.

Another embodiment is directed to a circuit for controlling actuation of a contactor. The contactor includes a plurality of switches mechanically coupled to an actuator moveable in opposite directions between a first position and a second position to change a state of the plurality of switches. The circuit includes a first input circuit for receiving a power-up signal and a second input circuit for receiving a trip signal. A coil has first and second ends. The moveable actuator extends through the coil as a core. The coil is capable of moving the actuator from the first position to the second position upon receipt of a power-up signal applied to the first input circuit, and capable of moving the actuator from the second position to the first position upon receipt of a trip signal applied to the second input circuit. First and second switches are coupled to respective first and second ends of the coil for reversing the polarity of the coil each occurrence of the actuator being actuated. The first and second switches are switchable to include the coil in the second input circuit when the actuator is in the second position such that when the trip signal is received on the second input circuit the coil is energized to operate the actuator to transition to the first position. The first and second switches are switchable to include the coil in the first input circuit when the actuator is in the first position such that when the power-up signal is received on the first input circuit the coil is energized to operate the actuator to transition to the second position. As the actuator is being actuated the first and second switches change state in preparation to energize the coil to be magnetically polarized in an opposite polarization direction during a next subsequent actuation.

Yet another embodiment is directed to a method of operating a contactor. The contactor includes a plurality of switches mechanically coupled to an actuator moveable in opposite directions between a tripped position and an operational position to change a state of the plurality of switches. The moveable actuator extends through a coil as a core. The coil is capable of moving the actuator when energized. The method includes receiving a power-up signal on a first input circuit and applying the power-up signal to the coil to actuate the actuator such that the actuator transitions from the tripped position to the operational position such that the plurality of switches transition to respective states corresponding to the operational position. Simultaneous with actuating the actuator, removing the first and second ends of the coil from the first input circuit and coupling the first and second ends of the coil into a second input circuit in opposite polarity with respect to the circuit in preparation to energize the coil to be magnetically polarized in an opposite polarization direction during a next subsequent actuation.

A contactor includes a plurality of switches mechanically coupled to an actuator. The actuator is moveable between operational and tripped positions. Switches that are closed in the operational position are open in the tripped position, and vice versa. The actuator extends through a coil as a core. The coil moves the actuator when an input signal is applied to the coil. A first input circuit receives a power-up signal to transition the contactor from a tripped position to an operational position. A second input circuit receives a trip signal to transition the contactor from the operational position to the tripped position. First and second switches, coupled to respective first and second ends of the coil, reverse the polarity of the coil each occurrence of the actuator being actuated in preparation for the coil to be energized and magnetically polarized in an opposite direction during a next subsequent actuation.

DETAILED DESCRIPTION OF EMBODIMENTS OF THE INVENTION

Figure 1:
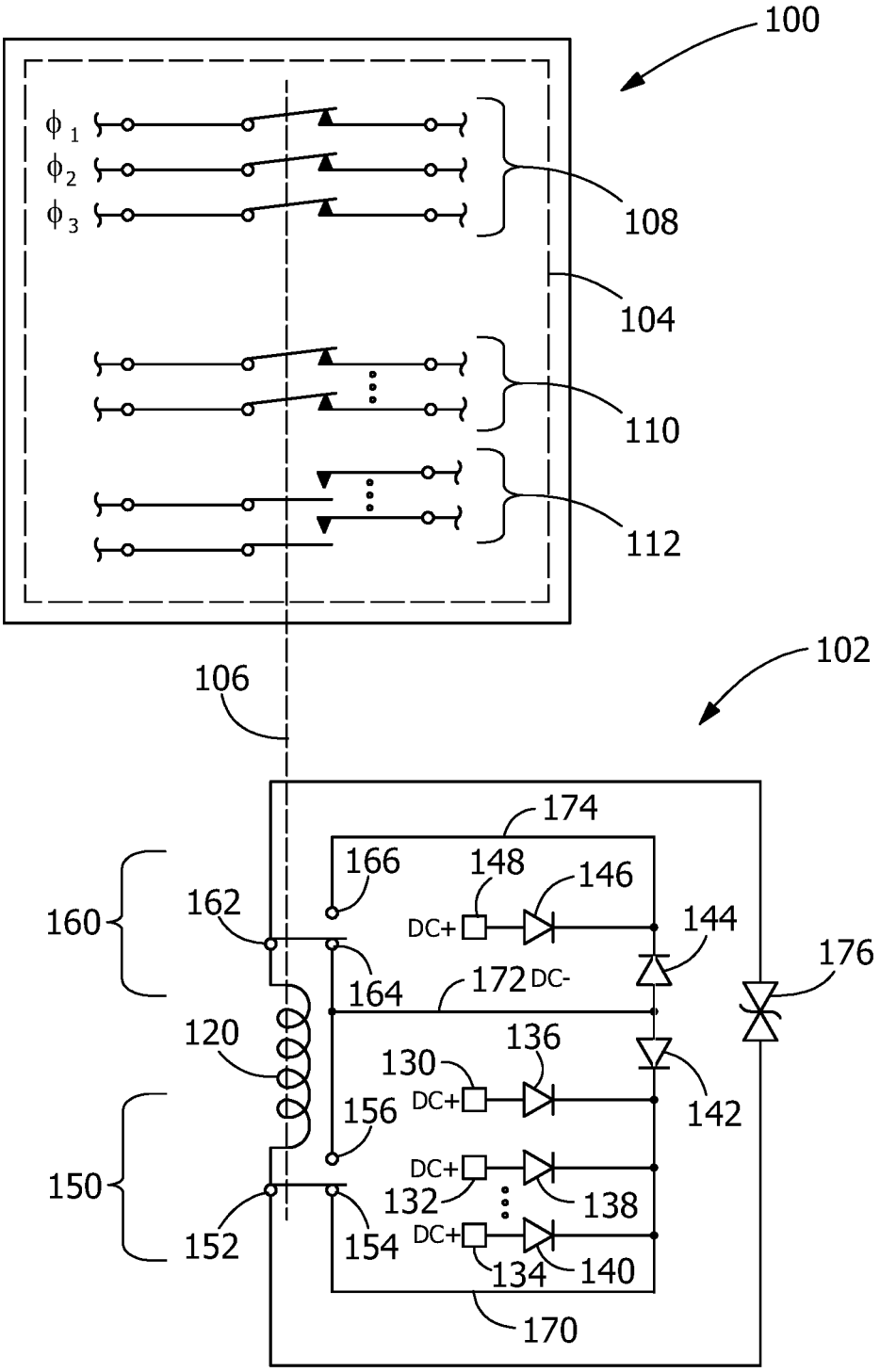
FIG. 1 is a schematic diagram illustrating a contactor and a control circuit of an illustrative embodiment according to the present invention.

FIG. 1 is a schematic diagram illustrating a latching contactor 100 and a control circuit 102 of an illustrative embodiment of the present invention. Contactor 100 includes an array of switches 104 and an actuator 106. In some embodiments, the mains switches 108 may be three phase contacts rated in the range of 25 amperes to 700 amperes, 115 volts that switch power on or off to all other circuits served by contactor 100. The mains switches 108 are normally closed switches which provide power to other circuits served by contactor 100 when in the closed position. A plurality of auxiliary, normally closed, switches 110 and a plurality of auxiliary, normally open, switches 112 may have contacts rated at 100 milliamps to 7 amperes continuous load. The mains switches 108, normally closed switches 110 and normally open switches 112 in the array of switches 104 in contactor 100 are mechanically linked to actuator 106. The switches in the array of switches 104 have two states, change state concurrently, and are in a known state, such as opened or closed, relative to the state of the mains switches 108. Some of the switches in the array of switches 104 may have adjustable operating points that can be preset to introduce a delay in operation of the switch from opening or closing. In some embodiments, individual switches in the array of switches 104 are coupled to circuits in a system in which the contactor 100 is installed.

Contactor 100 is illustrated in FIG. 1 in an operational position with the switches in the array of switches 104 in a respective position corresponding to the mains switches 108 being closed. The mains switches 108 and other normally closed switches 110 are closed and the normally open switches 112 are open.

Control circuit 102 controls providing energy to coil 120 to change the state of contactor 100. Control circuit 102 includes coil 120 having a portion of actuator 106 passing through the coil and functioning as a core. The magnetic field produced by the coil 120 when energized momentarily causes the actuator 106 to move in the direction of the oppositely charged pole of the actuator stator. In some embodiments, two coils occupying the same space as prior designs occupied are wired in parallel with the same magnetic polarity. The two physical windings of coil 120 form a single inductor with a stronger magnetic field capacity and approximately double the inductance and the magnetic field strength of the individual windings. A larger current causes the actuator 106 to operate more quickly, that is to transition from a present state to a next state more quickly than prior contactor designs.

Contactor 100 is a two-state, latching contactor that is energized momentarily to transition the contactor 100 from a present state to the next state. As is known in the latching contactor art, a permanent magnet (not shown) maintains or holds the contactor 100 in the newly positioned state. Power is not continuously required to hold the actuator in either state.

When the coil 120 is again energized momentarily, the contactor 100 overcomes the magnetic force holding the contactor 100 in the present state and the contactor 100 transitions to the next state as inertia of the actuator and the attraction from the opposite magnetic pole drive the actuator fully to the next state where it is maintained by the permanent magnet. The two states of the contactor 100 are an operational state and a tripped state. The contactor 100 toggles between the two states. When the present state of the contactor 100 is the operational state, the next state to which the contactor will transition is the tripped state. When the present state of the contactor 100 is the tripped state, the next state to which the contactor 100 will transition is the operational state.

To transition to the tripped state from the operational state of FIG. 1, control circuit 102 receives a trip signal. The trip signal is a dc signal of sufficient voltage and current magnitude to energize coil 120 to move actuator 106. In some embodiments, the trip signal is received from inside the system in which the contactor 100 is installed. In other embodiments the trip signal may be received from outside the system in which the contactor 100 is installed. The trip signal is received on any one of a plurality of terminals 130, 132, and 134. Diodes 136, 138, 140 and 142 prevent energy from the trip signal received on one of terminals 130, 132, or 134 from being fed into, or back into, the system. The trip signal energy is directed through conductor 170, switch 150, coil 120, switch 160, conductor 172, and return to ground to momentarily energize coil 120, which in turn transitions contactor 100 to the tripped state. Diode 146 prevents trip signal energy from being fed into, or back into, the system through terminal 148, depending upon the location of the source of the trip signal. Terminals 130 to 134, diodes 136 to 142, conductors 170 and 172 form a trip signal input circuit. In some embodiments, the trip signal, as well as the power-up signal, are nominally a 28 volt signals, diodes 136, 138, 140, 142, 144, and 146 may be rated at 250 volts, switches 150 and 160 may be rated at 7.5 amperes. In other embodiments, where the coil and other circuit components are appropriately rated, the control circuit could be operated at voltages below 28 volts, for example, including but not limited to, 12 volts, or above 28 volts, for example, including but not limited to 48 volts.

As the magnetic field in coil 120 strengthens when coil 120 is momentarily energized, the magnetic field in coil 120 causes the position of the actuator 106 to transition the contactor 100 to the next state, which in this case is to a tripped state. As described below, as the actuator 106 transitions the contactor 100 to the next state the single-pole 152 of switch 150 is transitioned from the first throw 154 to the second throw 156 and the single-pole 162 of switch 160 is transitioned from the first throw 164 to the second throw 166 to position switches 150 and 160 to reverse the direction current will pass through the coil the next occurrence of the coil being energized, thereby reversing the magnetic polarity of the coil 120. The previous positive input to the coil 120 becomes the negative input to the coil 120, and the previous negative input to the coil 120 becomes the positive input to the coil 120. The polarity of the coil 120 is reversed so the next time the coil is energized the magnetic field is developed in the opposite direction. Since the contactor 100 operates in only two states, switching the polarity of the coil 120 each time the contactor 100 is actuated sets-up the coil to actuate the contactor 100 in the opposite direction during the next actuation of contactor 100. Thereby setting-up the control circuit 102 in this case to transition to the next state, the operational state, when an operate signal is received on terminal 148.

When the polarity of the coil 120 is reversed by changing the position of switches 150 and 160 while the actuator 106 is transitioning from a present state to a next state, the current passing through the coil 120 is abruptly interrupted. Since the magnetic field strength of coil 120 is approximately twice the magnetic field strength of coils in prior contactor designs, the energy stored in the magnetic field to be dissipated causes a back electromotive force that is approximately twice as large and can be detrimental to switch contacts due to arcing and if not prevented from being fed back into the system. The collapsing magnetic field in coil 120 produces a large voltage transient to disperse the energy stored in the magnetic field and oppose the sudden change in current. The voltage transient can be orders of magnitude greater than the voltage that was applied across the coil 120 at the time the current was disconnected. The large voltage transient can damage electronics in the system, erode, weld or cause arcing between contacts of switches 150 and 160.

When a power-up signal, or a trip signal, is received by control circuit 102, energy is provided to coil 120 through switches 150 and 160. Sufficient energy is delivered to the coil 120—before the switches 150 and 160 open and cease providing a path for energy from the received signal to energize the coil 120—for coil 120 to operate. The switch operating points of switches 150 and 160 are adjusted and preset so that the opening of switches 150 and 160 does not occur until the actuator moves about halfway to the final actuator position of the next state. The inertia of the actuator and the magnetic attraction from the opposite magnetic pole drives the actuator fully to the next state. Since the coil is sufficiently energized to cause the actuator to transition to the next state before the switches 150 and 160 are transitioned to their next state by the movement of the actuator to the next state, the switches 150 and 160 transitioning to an open state, relative to the circuit that last energized coil 120 momentarily, does not adversely impact operation of the coil or the actuator.

Some embodiments of low power systems in which contactor 100 is installed are capable of withstanding the back electromotive force generated when switches 150 and 160 reverse polarization of coil 120. Such systems do not require transient voltage suppression. Embodiments of other systems that are less tolerant of the back electromotive force generated when switches 150 and 160 reverse polarization of coil 120 will require low or intermediate levels of voltage suppression provided by transient voltage suppression diodes. Yet other embodiments of the invention will require an even higher level of voltage suppression discussed below with reference to FIG. 3.

A transient voltage generated by coil 120 can be suppressed by a suppression device in parallel with the coil 120. Transient voltage suppression diodes 176, which have a voltage-current characteristic that is similar to Zener diodes and silicon avalanche diodes, are specifically designed for bidirectional transient voltage suppression and have a voltage-current characteristic that is similar to Zener diodes. Diodes 176 will conduct current up to the voltage limit for which the diode is designed to breakdown, not allowing the voltage to exceed the breakdown voltage.

Coil 120 operates intermittently for only a few milliseconds each occurrence and does not overheat due to being driven by a larger current than prior designs. The larger power due to larger current results in a faster transition of the contactor 100 from a present state to a next state and provides a design that can transition from a present state to a next state when the power-up signal or the trip signal is as low as 13 volts.

Figure 2:
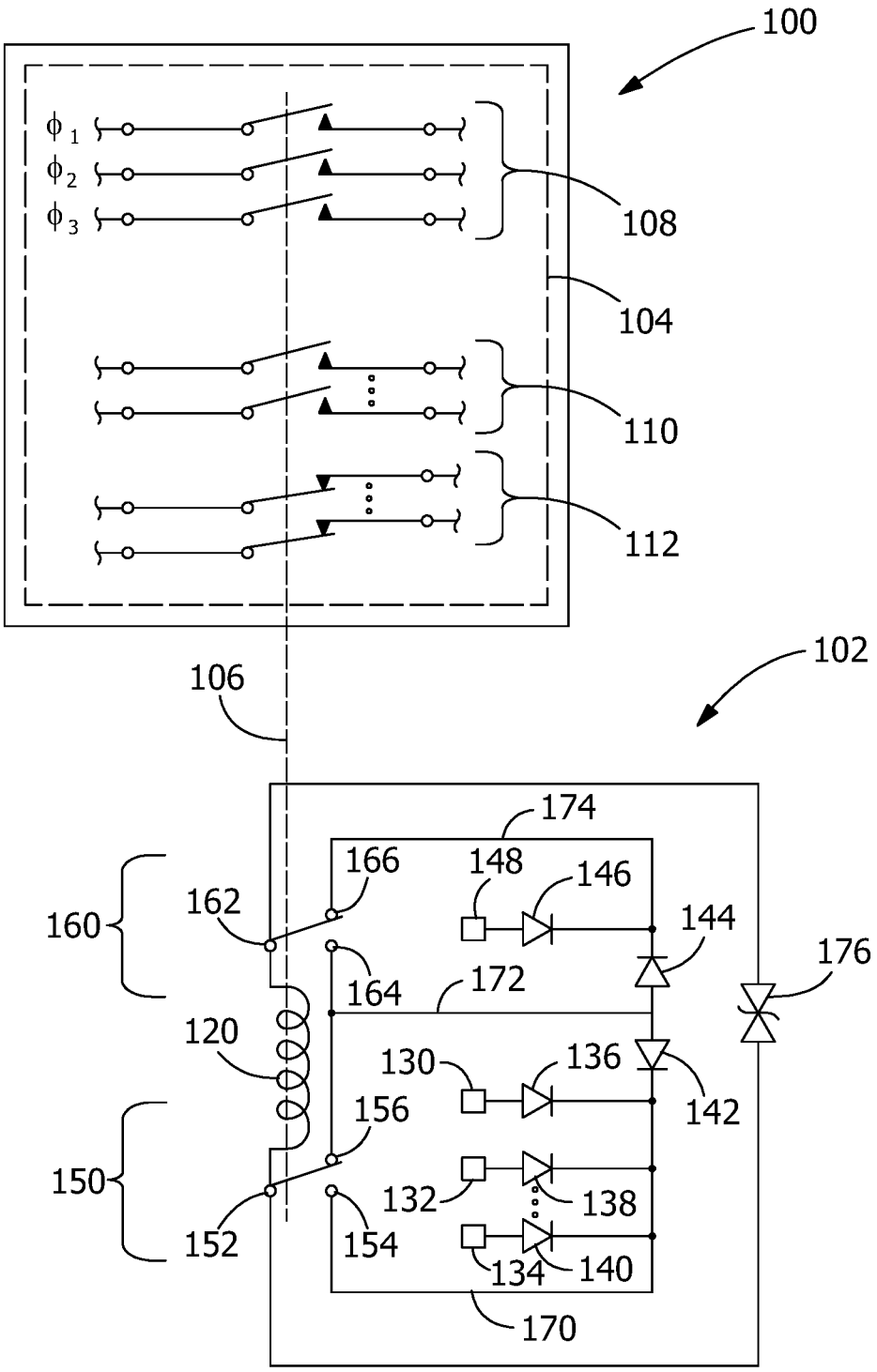
FIG. 2 is a schematic diagram illustrating the contactor and control circuit of FIG. 1 in a tripped state.

FIG. 2 is a schematic diagram illustrating the contactor 100 and control circuit 102 in a tripped state, with the switches in the array of switches 104 in a respective position corresponding to the mains switches 108 being opened. The mains switches 108 and other normally closed switches 110 are opened and the normally open switches 112 are closed. To transition to the operational state from the tripped state of FIG. 1, control circuit 102 receives a power-up signal. The power-up signal is a dc voltage signal of a sufficient voltage and current to energize coil 120 to move actuator 106. The power-up signal may be received from outside the system in which the contactor 100 is installed. The power-up signal is received on terminal 148. Diode 144 prevents energy from the power-up signal received on terminal 148 from being fed into, or back into, the system. The power-up signal energy is directed through conductor 174, switch 160, coil 120, switch 150, conductor 172, and diode 144 to momentarily energize coil 120, which in turn transitions contactor 100 to the operational state. Diodes 136, 138, and 140 prevent the power-up signal energy from being fed into, or back into, the system through terminals 130, 132, and 134. Terminal 148, diodes 144 and 146, and conductors 172 and 174 form a power-up signal input circuit.

As the magnetic field in coil 120 strengthens when coil 120 is momentarily energized, the magnetic field in coil 120 causes the position of the actuator 106 to transition the contactor 100 to the next state, which in this case is to the operational state. Concurrently, the single-pole 152 of switch 150 is transitioned from the second throw 156 to the first throw 154 and the single-pole 162 of switch 160 is transitioned from the second throw 166 to the first throw 164 to position switches 150 and 160 to reverse the polarity of the coil 120. The previous positive input to the coil 120 becomes the negative input to the coil 120, and the previous negative input to the coil 120 becomes the positive input to the coil 120. The polarity of the coil 120 is reversed so the next time the coil 120 is energized the magnetic field is developed in the opposite direction from the polarity of the previous actuation. Since the contactor 100 operates in only two states, switching the polarity of the coil 120 each time the contactor 100 is actuated sets-up the coil to actuate the contactor 100 in the opposite direction during the next actuation of contactor 100. Thereby setting-up the control circuit 102 in this case to transition to the next state, the tripped state, when a trip signal is received on one of terminals 130, 132, or 134.

When the polarity of the coil 120 is reversed by changing the position of switches 150 and 160, the current passing through the coil 120 is abruptly interrupted causing the collapsing magnetic field in coil 120 produces a large voltage transient to disperse the energy stored in the magnetic field and oppose the sudden change in current as described above.

Figure 3:
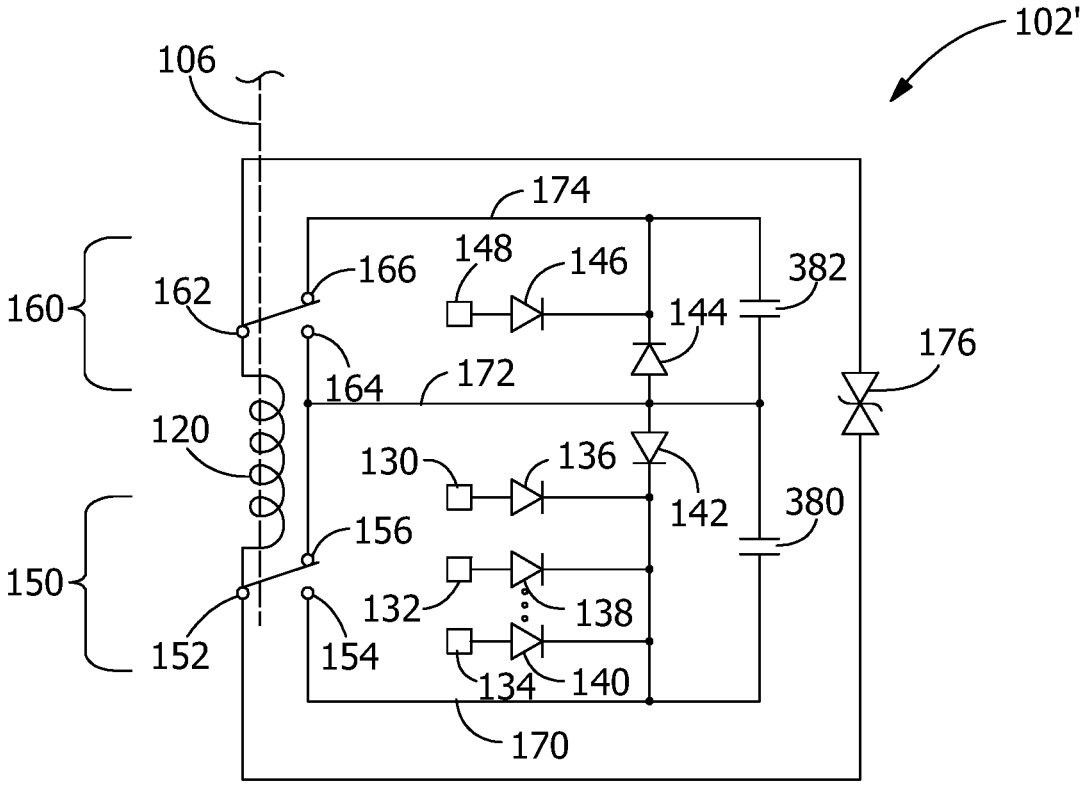
FIG. 3 is a schematic diagram of an illustrative alternative embodiment control circuit.

A large voltage transient caused by a sudden change in the magnitude of current passing through the coil 120, including a cessation of current through the coil 120, can damage electronics in the system, erode, weld or cause arcing between contacts of switches 150 and 160. FIG. 3 is a schematic diagram of an illustrative alternative embodiment control circuit 102' which includes capacitors 380 and 382. Capacitors 380 and 382 provide transient voltage suppression. Capacitor 380 and 382 are coupled across switches 150 and 160, respectively. Capacitors 380 and 382 increase the life of switches 150 and 160 by offsetting the inductive collapse of the coil windings, which substantially reduces arcing in switches 150 and 160 as the transient energy is dissipated. In some embodiments, capacitors 380 and 382 may be rated at 250 volts.

Depending on the level of voltage suppression required, in some embodiments capacitors 380 and 382 can be used independently and in other embodiments transient suppression diodes 176 can be used independently. In yet other embodiments, the transient suppression diodes 176 can be used in combination with capacitors 380 and 382, as illustrated in control circuit 102' of FIG. 3, for more effective transient voltage suppression. The transient suppression diodes (TSV) 176 limit the back electromotive force to a level that is not damaging to contacts and other components of the circuit.

Figure 4:
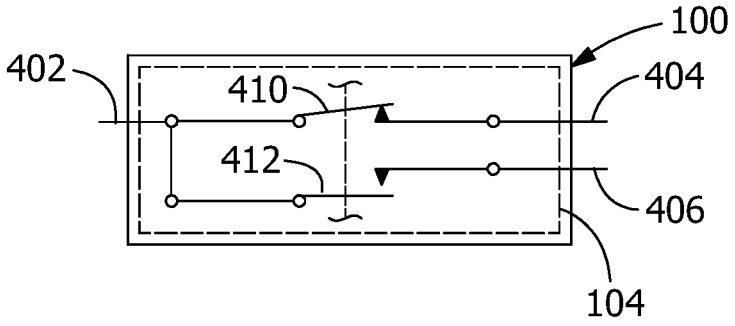
FIG. 4 is a schematic diagram illustrating wiring two single-pole, single-throw switches in a contactor to function as a single-pole, double-throw switch.

FIG. 4 is a schematic diagram illustrating wiring two single-pole, single-throw switches in a contactor 100 to function as a single-pole, double-throw switch. A conductor 402 is coupled to the single pole of both normally closed switch 410 and normally open switch 412. From the switch positions illustrated in FIG. 4, when actuated, actuator 106 operates to simultaneously open switch 410 and close switch 412 thereby transferring a conduction path initially established between conductor 402 and conductor 404 through switch 410, to be from conductor 402 to conductor 406 through switch 412. In this manner, a pair of simultaneously operated single-pole, single-throw switches, one normally open and the other normally closed, can be used to imitate the operation of a single-pole, double-throw switch.

The invention claimed is:

1. A contactor, comprising:

a plurality of switches;

a first input circuit for receiving a power-up input signal;

a second input circuit for receiving a trip input signal;

a movable actuator mechanically coupled to switches in the plurality of switches, the actuator moveable between a tripped position and an operational position upon receipt of a power-up input signal on the first input circuit, and moveable between the operational position and the tripped position upon receipt of a trip input signal on the second input circuit;

a coil having first and second ends, the moveable actuator extending through the coil as a core, the coil capable of moving the actuator when either a power-up input signal is received by the first input circuit or a trip input signal is received by the second input circuit;

first and second switches coupled to respective first and second ends of the coil for reversing the polarity of the coil each occurrence of the actuator being actuated, the first and second switches being switchable to include the coil in the second input circuit when the actuator is in the operational position, wherein when the trip input signal is received on the second input circuit the coil is energized to operate the actuator to transition to the tripped position, and the first and second switches being switchable to include the coil in the first input circuit when the actuator is in the tripped position, wherein when the power-up input signal is received on the first input circuit the coil is energized to operate the actuator to transition to the operational position;

wherein as the actuator is being actuated the first and second switches change state in preparation to energize the coil to be magnetically polarized in an opposite polarization direction during a next subsequent actuation.

2. The contactor as recited in claim 1, further comprising a transient voltage suppression device coupled between the first and second ends of the coil, the transient voltage suppression device for reducing transient voltages when current passing through the coil is abruptly terminated.

3. The contactor as recited in claim 2, wherein the transient voltage suppression device is a bidirectional device.

4. The contactor as recited in claim 2, wherein the transient voltage suppression device is a silicon avalanche diode.

5. The contactor as recited in claim 1, wherein the first and second switches are single-pole, double throw switches.

6. The contactor as recited in claim 5, wherein at least one of the single-pole, double throw switches comprises a normally open single-pole, single-throw switch and a normally closed single-pole, single throw switch in the plurality of switches.

7. The contactor as recited in claim 5, further comprising a capacitor coupled across the throws of at least one of the single-pole, double-throw switches.

8. A circuit for controlling actuation of a contactor, the contactor having a plurality of switches mechanically coupled to an actuator moveable in opposite directions between a first position and a second position to change a state of the plurality of switches, the circuit comprising:

a first input circuit for receiving a power-up signal;

a second input circuit for receiving a trip signal;

a coil having first and second ends, the moveable actuator extending through the coil as a core, the coil capable of moving the actuator from the first position to the second position upon receipt of a power-up signal applied to the first input circuit, and capable of moving the actuator from the second position to the first position upon receipt of a trip signal applied to the second input circuit;

first and second switches coupled to respective first and second ends of the coil for reversing the polarity of the coil each occurrence of the actuator being actuated, the first and second switches being switchable to include the coil in the second input circuit when the actuator is in the second position, wherein when the trip signal is received on the second input circuit the coil is energized to operate the actuator to transition to the first position, and the first and second switches being switchable to include the coil in the first input circuit when the actuator is in the first position, wherein when the power-up signal is received on the first input circuit the coil is energized to operate the actuator to transition to the second position;

wherein as the actuator is being actuated the first and second switches change state in preparation to energize the coil to be magnetically polarized in an opposite polarization direction during a next subsequent actuation.

9. The circuit as recited in claim 8, further comprising a transient voltage suppression device coupled between the first and second ends of the coil, the transient voltage suppression device for reducing transient voltages when current passing through the coil is abruptly terminated.

10. The circuit as recited in claim 9, wherein the transient voltage suppression device is a bidirectional device.

11. The circuit as recited in claim 9, wherein the wherein the transient voltage suppression device is selected from the group consisting of a silicon avalanche diode and a Zener diode.

12. The circuit as recited in claim 8, wherein the first and second switches are single-pole, double throw switches.

13. The circuit as recited in claim 12, wherein at least one of the single-pole, double-throw switches is comprised of a normally open single-pole, single-throw switch and a normally closed single-pole, single throw switch in the plurality of switches.

14. The circuit as recited in claim 12, further comprising a capacitor coupled across the throws of each of the single-pole, double-throw switches.

15. A method of operating a contactor, the contactor having a plurality of switches mechanically coupled to an actuator moveable in opposite directions between a tripped position and an operational position to change a state of the plurality of switches, the moveable actuator extending through a coil as a core, the coil capable of moving the actuator when energized, comprising:

receiving a power-up signal on a first input circuit;

applying the power-up signal to the coil to actuate the actuator such that the actuator transitions from the tripped position to the operational position, wherein the plurality of switches transition to respective states corresponding to the operational position;

receiving a trip signal on the second input circuit;

applying the trip signal to the coil to actuate the actuator such that the actuator transitions from the operational position to the tripped position, wherein the plurality of switches transition to respective states corresponding to the tripped position;

switching first and second switches coupled to the respective first and second ends of the coil for reversing the polarity of the coil each occurrence of the actuator being actuated.

16. The method of operating a contactor as recited in claim 15, further comprising:

upon actuating the actuator in response to the power-up signal applied to the coil, initiating removal of the first and second switches coupled to the first and second ends of the coil from the first input circuit and coupling the first and second ends of the coil into a second input circuit in opposite polarity in preparation to energize the coil to be magnetically polarized in an opposite polarization direction during a next subsequent actuation;

upon actuating the actuator in response to the trip signal applied to the coil, initiating removal of the first and second switches coupled to the first and second ends of the coil from the second input circuit and coupling the first and second ends of the coil into the first input circuit in opposite polarity in preparation to energize the coil to be magnetically polarized in an opposite polarization direction during a next subsequent actuation.

17. The method of operating a contactor, as recited in claim 15, further comprising:

providing voltage suppression across the coil to attenuate transient voltages caused by interruption of current passing through the coil.

18. The method of operating a contactor, as recited in claim 15, wherein initiating removal of first and second ends of the coil from the second input circuit comprises presetting an operating point of at least one switch.

19. The method of operating a contactor, as recited in claim 15, further comprising:

suppressing arcing when the first and second ends of the coil are removed from the first input circuit and coupled to the second input circuit.

20. The method of operating a contactor, as recited in claim 15, further comprising:

suppressing arcing when the first and second ends of the coil are removed from the second input circuit and coupled to the first input circuit.

* * * * *